US007912405B2

(12) United States Patent
Nakanishi et al.

(10) Patent No.: US 7,912,405 B2
(45) Date of Patent: Mar. 22, 2011

(54) IMAGE FORMING APPARATUS HAVING A PLURALITY OF IMAGE FORMING UNITS

(75) Inventors: Takashi Nakanishi, Abiko (JP); Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 12/212,092

(22) Filed: Sep. 17, 2008

(65) Prior Publication Data

US 2009/0080934 A1 Mar. 26, 2009

(30) Foreign Application Priority Data

Sep. 21, 2007 (JP) ..... 2007-245544

(51) Int. Cl.
*G03G 15/00* (2006.01)
*G03G 15/01* (2006.01)
*G03G 21/16* (2006.01)

(52) U.S. Cl. ..... 399/111; 399/12; 399/112

(58) Field of Classification Search ..... 399/112, 399/111, 110, 12; 347/49, 86, 138, 152
See application file for complete search history.

(56) References Cited

U.S. PATENT DOCUMENTS

| | | | | |
|---|---|---|---|---|
| 6,175,711 | B1 | 1/2001 | Yoshino et al. | |
| 6,453,136 | B1 * | 9/2002 | Yasumaru | 399/111 |
| 6,537,715 | B2 | 3/2003 | Mizoo et al. | 430/108.22 |
| 6,571,073 | B1 | 5/2003 | Suzuki et al. | 399/116 |
| 6,980,758 | B2 | 12/2005 | Murayama et al. | |
| 7,024,133 | B2 | 4/2006 | Nagashima et al. | 399/111 |
| 7,340,197 | B2 | 3/2008 | Murayama et al. | |
| 2005/0047821 | A1 | 3/2005 | Murayama et al. | |
| 2005/0191086 | A1 * | 9/2005 | Kawai et al. | 399/110 |
| 2005/0260011 | A1 | 11/2005 | Murayama et al. | |
| 2008/0138110 | A1 * | 6/2008 | Yoshino et al. | 399/114 |
| 2008/0310882 | A1 * | 12/2008 | Kato et al. | 399/114 |
| 2009/0028601 | A1 * | 1/2009 | Mizuno et al. | 399/111 |
| 2009/0290903 | A1 * | 11/2009 | Horikawa et al. | 399/111 |

FOREIGN PATENT DOCUMENTS

| | | |
|---|---|---|
| JP | 2002-62782 | 2/2002 |
| JP | 2004-101961 | 4/2004 |
| JP | 2004-212986 | 7/2004 |
| RU | 2 107 047 | 3/1998 |

(Continued)

OTHER PUBLICATIONS

Machine translation of JP 2004-101961 A dated Mar. 30, 2010.*

(Continued)

*Primary Examiner* — Sophia S Chen
(74) *Attorney, Agent, or Firm* — Fitzpatrick, Cella, Harper & Scinto

(57) ABSTRACT

An image forming apparatus includes a plurality of image forming units, each provided with an image bearing member, detachably mountable to a main assembly of the image forming apparatus; an opening, provided in a side surface of the main assembly, for permitting insertion of the plurality of image forming units into the opening; a guide portion for guiding the plurality of image forming units toward the opening; and a projected portion, provided on the guide portion, for positioning a part of an associated image forming unit outside the opening by contacting the associated image forming unit when the associated image forming unit is inserted into the opening with an attitude different from the attitude of the associated image forming unit at the time when the associated image forming unit is disposed in the main assembly.

20 Claims, 9 Drawing Sheets

FOREIGN PATENT DOCUMENTS

| | | |
|---|---|---|
| RU | 2 168 765 | 6/2001 |
| RU | 2289835 | 12/2006 |

OTHER PUBLICATIONS

Russian Office Action issued in Russian Application No. 2008137666/28(048486) dated Nov. 17, 2009.

Russian Office Action issued Mar. 12, 2010, in Russian Application No. 2008137666/28(048486), and English-language translation thereof.

Chinese Office Action dated Jun. 12, 2010, issued in counterpart Chinese Application No. 200810149711.X, and English-language translation thereof.

* cited by examiner

IMAGE FORMING APPARATUS HAVING A PLURALITY OF IMAGE FORMING UNITS

FIELD OF THE INVENTION AND RELATED ART

The present invention relates to an image forming apparatus, in which a plurality of process cartridges (image forming units), each including an image bearing member, is detachably mountable to a main assembly of the image forming apparatus, for forming an image on a recording material. For example, the image forming apparatus includes image forming units used in color electrophotographic copying machines, color electrophotographic printers (a color laser printer, a color LED printer, etc.) and the like.

A conventional image forming apparatus of this type includes, e.g., a tandem type color electrophotographic image forming apparatus using a plurality of image forming units (process cartridges) for forming color components images of yellow, magenta, cyan, black, etc.

The process cartridge is provided by integrally forming a photosensitive member as an image bearing member and image forming process means acting on the photosensitive member in a cartridge (unit) which is detachably mountable to a main assembly of the electrophotographic image forming apparatus. The image forming process means is, e.g., at least one of charging means for electrically charging the photosensitive member uniformly, developing means for developing an electrostatic image formed on the photosensitive member, and cleaning means for removing toner remaining on the photosensitive member after transfer. The main assembly refers to an image forming apparatus main assembly to which the process cartridges are detachably mountable.

Japanese Laid-Open Patent Application 2002-62782 describes the following constitution as a detachably mountable constitution of four process cartridges (photosensitive member units) with respect to the main assembly. In the image forming apparatus to which such a plurality of process cartridges is mountable, the process cartridges are liable to be inserted into the main assembly with a proper attitude by partitioning an opening as an inserting opening for adjacent process cartridges.

In recent years, in order to realize high productivity, a constitution (an in-line image forming apparatus) is provided in which a plurality of process cartridges for respective colors is arranged in a line and toner images for the respective colors formed on respective photosensitive members are successively transferred onto an intermediary transfer belt to form a color image. In this constitution, in order to arrange the process cartridges in a width direction of the image forming apparatus, it is necessary to downsize the image forming apparatus with respect to the width direction. That is, it is necessary to decrease an interval between a first contact portion at which a first photosensitive member and the intermediary transfer belt contact each other and a second contact portion at which a second photosensitive member and the intermediary transfer belt contact each other. As a result, the spacing between adjacent process cartridges is decreased.

However, when a partition member for partitioning the inserting opening for adjacent process cartridges into two portions is provided, the spacing between the adjacent process cartridges cannot be decreased, so that the downsizing (compactification) of the image forming apparatus with respect to the width direction is not sufficiently achieved.

In order to solve such a problem, it is possible to minimize the spacing between the adjacent process cartridges by employing a constitution in which such a partition member is not provided.

However, when the partition member is omitted, adjacent inserting portions for inserting the adjacent process cartridges are continuously connected to each other to form a single large opening. For that reason, the entire opening is larger than the total area of the cross sections of the process cartridges with respect to a direction perpendicular to the insertion direction of one process cartridge, permitting the process cartridge to be inserted with an erroneous attitude when the process cartridge is inserted into the main assembly through the opening. As a result, there arises a problem such that the process cartridge is liable to be damaged.

SUMMARY OF THE INVENTION

In view of the above problem, a principal object of the present invention is to prevent insertion of an image forming unit with an erroneous attitude even when adjacent inserting portions for adjacent image forming units are continuously connected to each other to form a large opening.

According to the present invention, there is provided an image forming apparatus comprising:

a plurality of image forming units, each provided with an image bearing member, detachably mountable to a main assembly of the image forming apparatus;

an opening, provided in a side surface of the main assembly, for permitting insertion of the plurality of image forming units into the opening;

a guide portion for guiding the plurality of image forming units toward the opening; and a projected portion, provided on the guide portion, for positioning a part of an associated image forming unit outside the opening by contacting the associate image forming unit when the associated image forming unit is inserted into the opening with an attitude different from an attitude at the time when the associated image forming unit is disposed in the main assembly.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, with reference to the drawings, preferred embodiments of the present invention will be exemplarily described in detail. However, it should be understood that dimensions, materials, shapes, relative arrangement, and the like of constituent elements or means of the image forming apparatus according to the present invention are not limited to those described in the following embodiments unless otherwise specified.

First Embodiment

Hereinafter, a First Embodiment of the present invention will be described in detail with reference to the drawings.

Figure 1:
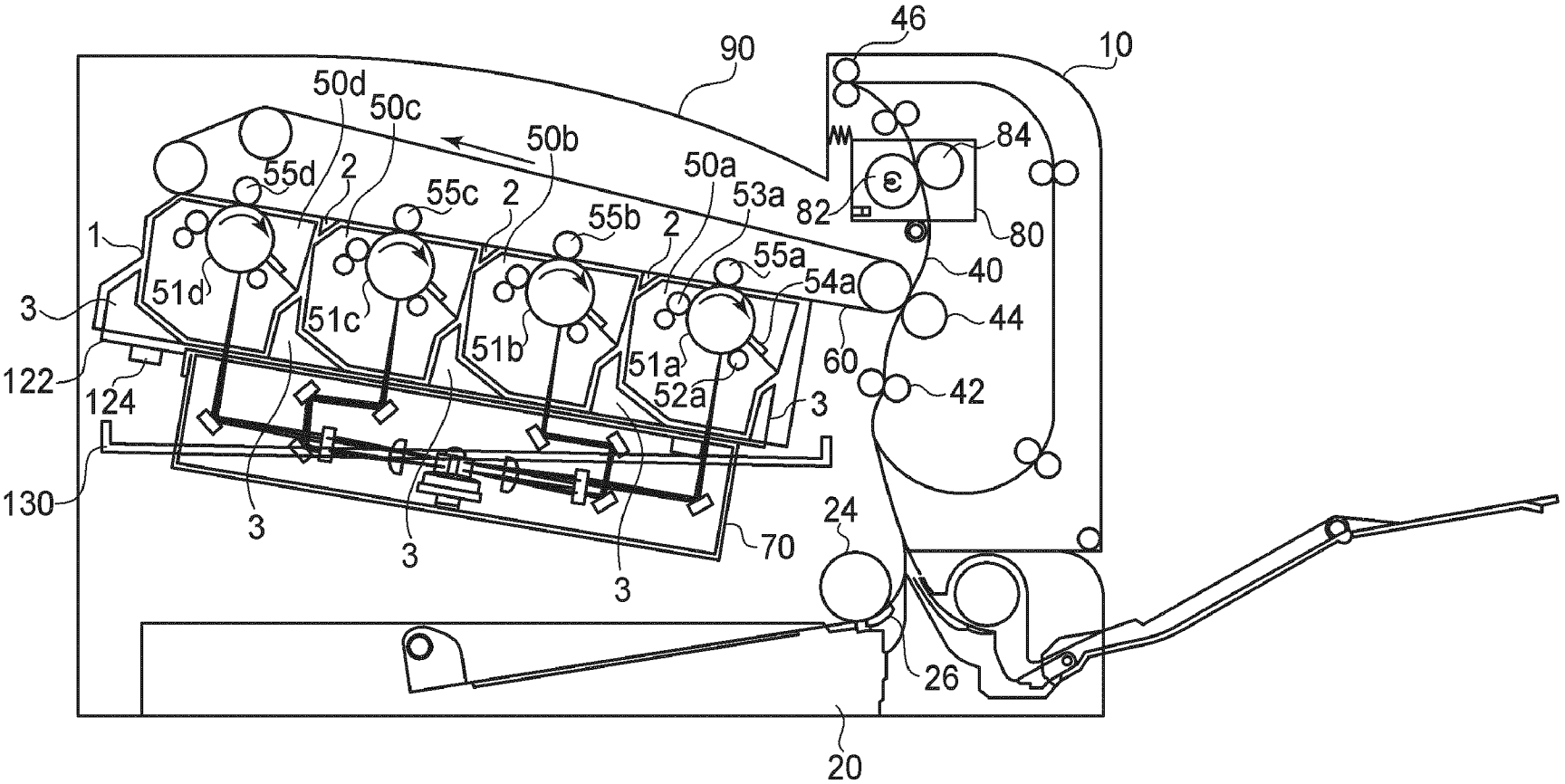
FIG. 1 is a schematic view showing an image forming apparatus 10 according to a First Embodiment of the present invention.
Figure 2:
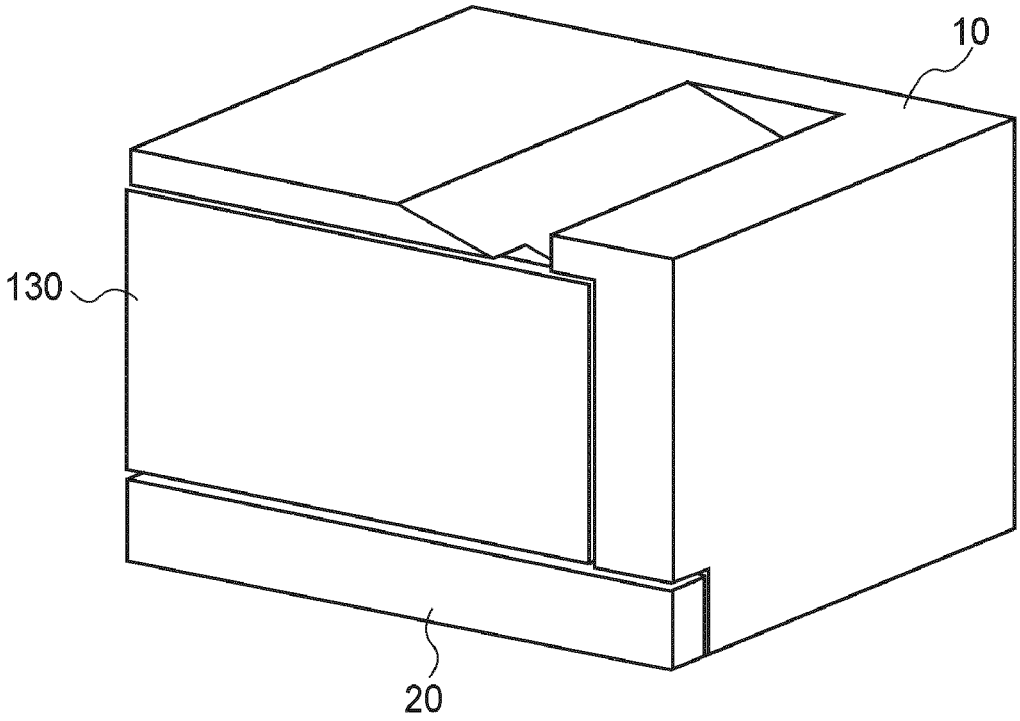
FIG. 2 is a perspective view of the outer appearance of the image forming apparatus 10.

FIG. 1 is a schematic view showing an embodiment of a full-color image forming apparatus (a full-color printer) 10 including an in-line type intermediary transfer belt (belt member) using a conventional electrophotographic process. FIG. 2 is a perspective view of an outer appearance of the image forming apparatus 10 shown in FIG. 1.

First, the image forming apparatus 10 will be described. This image forming apparatus 10 includes a process cartridge 50*a* for forming a black toner image, a process cartridge 50*b* for forming a cyan toner image, a process cartridge 50*c* for forming a magenta toner image, and a process cartridge 50*d* for forming a yellow toner image. In this embodiment, each of the process cartridges is used as an image forming unit. These four process cartridges 50*a*, 50*b*, 50*c* and 50*d* are arranged in a line with a certain spacing between adjacent process cartridges. In this embodiment, these process cartridges have the same constitution except for toners subjected to development. For this reason, the black process cartridge will be described. In the process cartridge 50*a*, a drum-type electrophotographic photosensitive member 51*a* as an image bearing member (hereinafter referred to as a "photosensitive drum") is provided. Each of the process cartridges, 50*a*, 50*b*, 50*c* and 50*d* is independently constituted so as to be detachably mountable to a main assembly of the image forming apparatus 10 with respect to a front direction of the image forming apparatus 10.

Around the photosensitive drum 51*a*, a primary charger 52*a* as a charging member (primary charging means), a developing device 53*a* as a developing means, a transfer roller 55*a* as a transfer means, and a cleaner device 54*a* as a cleaning means are disposed. Under the developing device 53*a*, a toner accommodating portion in which toner is accommodated is provided. Under each of the other developing devices of the other process cartridges 50*b*, 50*c*, and 50*d*, a toner accommodating portion is provided in which toner is accommodated.

The photosensitive drum 51*a* is a negatively chargeable OPC (organic photoconductor) photosensitive member and includes an aluminum-made drum substrate and a photoconductive layer formed on the drum substrate. The photosensitive drum 51*a* is rotationally driven at a predetermined process speed by a driving device (not shown).

The primary charger 52*a* as the primary charging means electrically charges a surface of the photosensitive drum 51*a* to a predetermined negative potential by a charging bias applied from a charging bias voltage source (not shown).

Referring to FIG. 1, below the process cartridges 50*a*, 50*b*, 50*c* and 50*d*, a laser exposure device 70 is disposed. The exposure device 70 is constituted by a laser light emitting means for emitting light corresponding to a time-series electrical digital pixel signal of given image information, a polygonal lens, a reflection mirror, etc. The laser exposure device 70 forms electrostatic latent images of respective colors corresponding to image information on the photosensitive drums 51*a*, 51*b*, 51*c* and 51*d*, respectively, electrically charged by the respective primary chargers 52 by subjecting the respective photosensitive drums 51*a*, 51*b*, 51*c* and 51*d* to light exposure.

The developing device 53*a* develops the electrostatic latent image into a toner image by depositing an associated color toner on the electrostatic latent image formed on the photosensitive drum 51*a*.

The transfer rollers 55*a*, 55*b*, 55*c* and 55*d* as the primary transfer means are disposed so that these rollers are press-contactable with the photosensitive drums 51*a*, 51*b*, 51*c* and 51*d*, respectively, by the medium of an intermediary transfer belt 60 as an intermediary transfer member. By these transfer rollers, the toner images on the respective photosensitive drums are transferred onto the intermediary transfer belt 60.

The cleaner device 54*a* includes a fur brush or a cleaning blade for removing a transfer residual toner, remaining on the photosensitive drum 51*a* after primary transfer, from the photosensitive drum 51*a*.

The intermediary transfer belt 60 as the intermediary transfer member is constituted by a dielectric resin material such as a polycarbonate film, a polyethylene terephthalate (resin) film, or a polyvinylidene fluoride (resin) film. In this embodiment, with respect to a vertical direction of the image forming apparatus, the process cartridges for the respective colors are disposed below the intermediary transfer belt 60.

A sheet feeding (conveying) path 40 is a sheet passage from a feeding roller 24 to discharge rollers 46 and is located in the neighborhood of a right-hand portion (in FIG. 1) of the image forming apparatus 10. The sheet feeding path 40 is formed so as to extend substantially vertically from a sheet feeding tray 20 to a heating roller (fixing roller) 82 and a pressing roller 84.

At a secondary transfer portion 44, a secondary transfer opposite roller is disposed so that it is press-contactable with a secondary transfer roller 44 by the medium of the intermediary transfer belt 60. The toner images superposed on the intermediary transfer belt 60 are transferred at the secondary transfer portion 44 onto a recording material P conveyed to the secondary transfer portion 44. Registration rollers 42 are disposed upstream of the secondary transfer portion 44.

Further, at a portion downstream of and above the secondary transfer portion 44 with respect to a conveyance direction of the recording material P, a fixing device 80 including the fixing roller 82 and the pressing roller 84 is disposed. A substantially vertical conveying path is formed between the secondary transfer portion 44 and the fixing device 80. The toner images transferred onto the recording material P at the secondary transfer portion 44 are fixed on the recording material P under application of heat and pressure by the fixing device 80. The fixing device 80 includes a fixing member for heating the toner images on the recording material and a pressing member for press-contacting the fixing roller to nip and convey the recording material P.

Next, an image forming operation by the above-described image forming apparatus will be described similarly with reference to FIGS. 1 and 2.

When an image formation start signal is provided, each of the photosensitive drums 51*a*, 51*b*, 51*c* and 51*d*, of the process cartridges 50*a*, 50*b*, 50*c* and 50*d*, rotationally driven at a predetermined process speed is negatively charged uniformly by an associated primary charger 52. Then, the exposure device 70 emits laser light, corresponding to a color-separated image signal inputted from external equipment, from a laser emitting element, so that an electrostatic latent image of each color is formed on an associated photosensitive drum 51*a*, 51*b*, 51*c* or 51*d* by the laser light exposure through the polygonal lens, the reflection mirror, etc.

Then, first, on the electrostatic latent image formed on the photosensitive drum 51*d*, a yellow toner is deposited by the yellow toner image developing device to which a developing bias (voltage) of an identical polarity to a charge polarity (negative polarity) of the photosensitive drum 51*d* is applied, so that the electrostatic latent image is visualized as a yellow toner image. This yellow toner image formed by the process cartridge 50*d* is then primary-transferred onto the intermediary transfer belt 60 at a primary transfer portion between the photosensitive drum 51*d* and the transfer roller 55*d* by the transfer roller 55*d* to which a primary transfer bias of a (positive) polarity opposite to the charge polarity of the toner is applied.

The intermediary transfer belt 60 on which the yellow toner image is transferred is moved toward the process cartridge 50*c*. Then, also in the process cartridge 50*c*, similarly as in the above described manner, a magenta toner image formed on the photosensitive drum 51*c* is superposed and transferred onto the yellow toner image on the intermediary transfer belt 60 at an associated primary transfer portion.

Then, transfer residual toner remaining on each photosensitive drum 51*a*, 51*b*, 51*c*, 51*d* is scraped off the photosensitive drum 51*a*, 51*b*, 51*c*, 51*d* by the cleaning blade or the like provided in a drum cleaner device associated therewith, thus being collected.

Thereafter, in a similar manner, on the yellow and magenta toner images transferred onto the intermediary transfer belt 60 in a superposition manner, a cyan toner image and a black toner image formed on the photosensitive drums 51*b* and 51*a* of the process cartridges 50*b* and 50*a*, respectively, are successively superposed at the respective primary transfer portions. Thus, full-color toner images are formed on the intermediary transfer belt 60.

The recording material fed from a sheet feeding tray 20 by the feeding roller 24 and is separated by a separating pad 26, so that only an uppermost recording sheet is guided into the sheet feeding path 40. Then the recording sheet (material) is temporarily stopped by the registration rollers 42. In synchronism with timing at which a leading end of the toner images on the intermediary transfer belt 60 is moved to the secondary transfer portion 44, the recording material P is conveyed to the secondary transfer portion by registration rollers 42. Onto the recording material P conveyed to the secondary transfer portion, the full-color toner images are secondary-transferred simultaneously by the secondary transfer roller to which a secondary transfer bias (of a (positive) polarity opposite to the charge polarity of the toner) is applied.

The recording material P on which the full-color toner images are formed is conveyed to the fixing device 80, in which the full-color toner images are heated and pressed in a fixing nip between the fixing roller and the pressing roller to be heat-fixed on a surface of the recording material. Thereafter, the recording material P is discharged on a sheet discharge tray 90 at an upper surface of the main assembly by sheet discharging rollers 46, so that a series of image forming operations is completed. Incidentally, secondary transfer residual toner or the like remaining on the intermediary transfer belt 60 is removed and collected by an unshown belt cleaning device.

In FIG. 2, a front cover 130 located at a front surface, which is one of side surfaces of the image forming apparatus 10, is constituted so as to be rotatable about a hinge provided at a lower end of the front cover 130. The front cover 130 is opened when the process cartridge is taken out of the image forming apparatus 10.

Figure 3A:
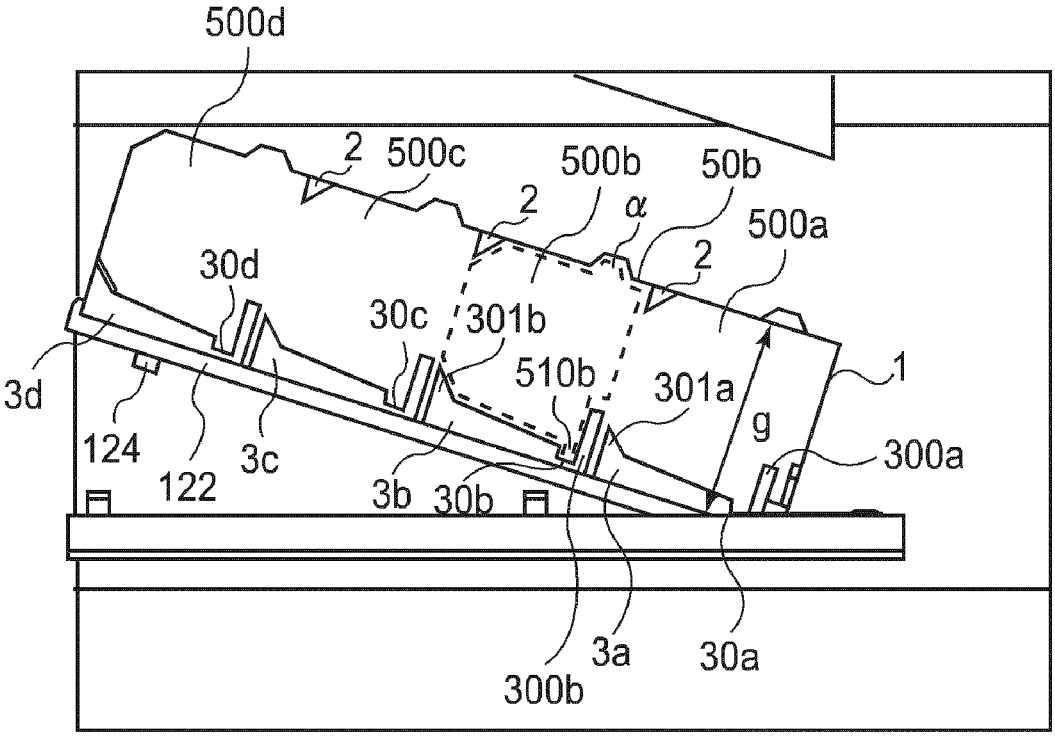
FIG. 3A is a schematic view showing the image forming apparatus 10 in the case where a process cartridge 50*a* is mounted and demounted.

When the front cover 130 is opened, an opening 1 is provided to the image forming apparatus 10 as shown in FIG. 3A. Through the opening, four process cartridges 50*a*, 50*b*, 50*c* and 50*d* are detachably mountable to the main assembly of the image forming apparatus 10. FIG. 3A is a schematic view showing a state in which the opening 1 is opened. In this embodiment, the opening 1 is formed in a single portion by continuous inserting portions 500*a* to 500*d* for inserting the process cartridges 50*a* to 50*d*. This opening 1 is preliminarily provided to a front plate of a frame of the image forming apparatus. In this embodiment, all the inserting portions are continuously provided but there is no problem even in a constitution in which a plurality of adjacent inserting portions is continuously formed in a single opening.

As shown in FIG. 3A, at a lower front portion of the main assembly, a rotatable cover (openable member) 122 rotatable about a rotatable cover hinge 124 is provided. This rotatable cover 122 opens and closes the opening 1. The rotatable cover 122 is provided inside the front cover 130. The rotatable cover 122 is opened and closed in interrelation with the front cover 130 and, in a closed state, is provided in substantially parallel to the front cover 130. The rotatable cover 122 is obliquely disposed so as to be in parallel to the process cartridges at an opened position of the front cover 130. At the opened position, on an upper surface of the rotatable cover 122, guide portions 3*a* to 3*d* for guiding the process cartridges for insertion into the inserting portions are provided corresponding to the process cartridges 50*a* to 50*d*, respectively. A state in which the process cartridge 50*b* is mounted on the guide portion 3*b* is indicated by a broken line. A projected portion 510*b* provided to the process cartridge 50*b* is engaged in a recessed portion 30*b* of the guide portion 3*b*, so that the process cartridge 50*b* is pushed toward the inserting portion. As a result, the process cartridge is guided into the main assembly of the image forming apparatus through the opening. Further, in the image forming apparatus, an inner guide portion for further guiding the process cartridge guided along the guide portion 3 in the image forming apparatus is provided on an extended line of the guide portion 3. The guide portion 3 provided to the rotatable cover 122 corresponds to a substantially lower half of an outer shape of the process cartridge.

Figure 3B:
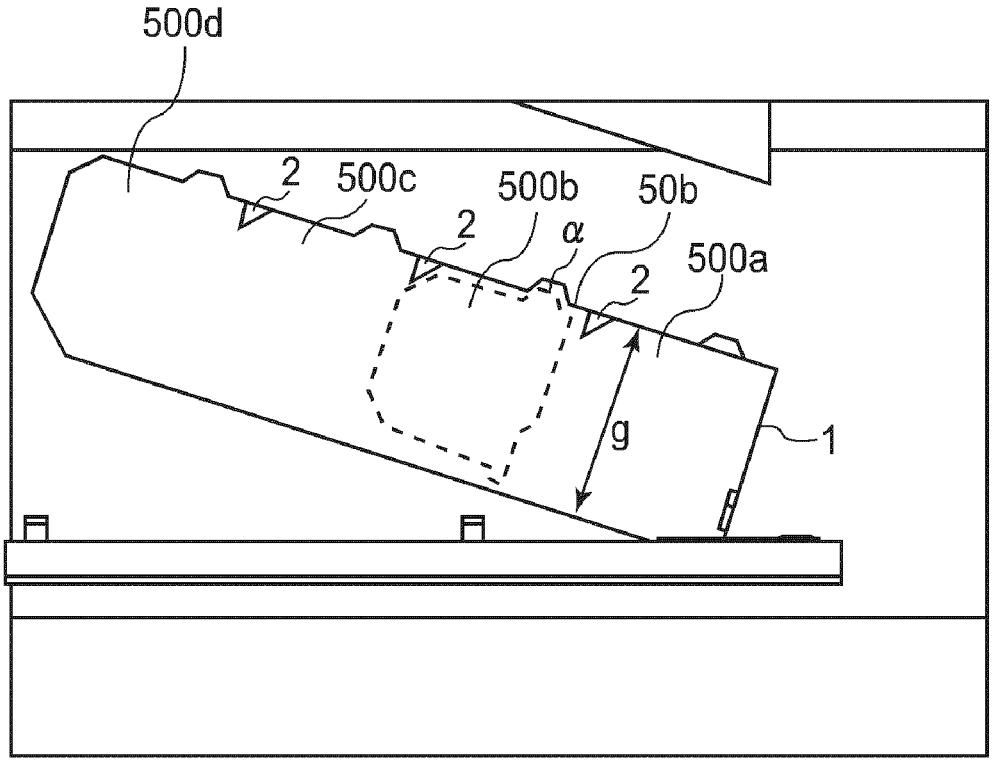
FIG. 3B is a schematic view showing an opening.

FIG. 3B is a schematic view showing a state in which the front cover and the rotatable cover are removed. A broken line indicated in FIG. 3B represents a cross section of the process cartridge. As is understood from this figure, when the front cover having the guide portion is removed, the size of the cross section of the opening 1 is larger than that of the cross section of the process cartridge. For that reason, the process cartridge can be inserted into the opening 1 with an attitude different from a proper (normal) attitude. When the process cartridge is prevented from being inserted into the opening 1 with the attitude different from the proper attitude only by the opening 1, it is necessary to provide a cross-sectional shape to each of the inserting portions so as to be substantially equal to a cross-sectional shape of each of the process cartridges with the proper attitude. In order to make the cross-sectional shapes of the inserting portion and the process cartridge substantially equal to each other, it is necessary to provide between adjacent inserting portions a member for making the cross-sectional shape of the inserting portion equal to that of the process cartridge. The member consequently partitions the adjacent inserting portions, so that a spacing between adjacent image forming units is increased. In the present invention, in order to reduce the spacing between the adjacent image forming units, such a partitioning member is reduced, so that the size of the inserting portion is made sufficiently larger than that of the cross section of the image forming unit.

To the opening 1, a regulating member 2 for regulating an upper shape as a part of the outer shape of the process cartridge is provided. As described above, in this embodiment, the upper shape of the inserting portion corresponds to that of the outer shape of the process cartridge and the shape of the guide portion corresponds to the lower shape of the outer shape of the process cartridge. In combination of these shapes of the inserting portion and the guide portion, the resultant shape is substantially equal to the entire cross-sectional shape of the process cartridge. As a result, the process cartridge mounted on the guide portion with the proper attitude is easily inserted. Further, in the case where the process cartridge is mounted on the guide portion with an erroneous attitude, the resultant cross-sectional shape of the process cartridge is different from the combined shape of the guide portion and the inserting portion, so that insertion of the process cartridge cannot be effected.

Herein, the proper attitude of the process cartridge refers to such an attitude that the photosensitive member is located at an upper portion of the process cartridge with respect to a vertical direction of the image forming apparatus. As a result of the proper attitude, the shape of the opening is not necessarily required to be equal to the cross-sectional shape of the process cartridge.

In the present invention, the guide portion is provided with the projected portion projected in a direction (a height direction in this embodiment) perpendicular to an insertion direction of the process cartridge into the main assembly of the image forming apparatus, thus preventing erroneous insertion of the process cartridge. Details will be described later. In the case where such a guide portion is provided, when the front cover 130 is opened, first a user places the lower portion of the process cartridge on the guide portion 3 and then can mount the process cartridge although the opening for inserting the plurality of image forming units is provided at the front surface of the main assembly.

However, there is also the case where the process cartridge is mounted on the guide portion with an attitude different from the proper attitude to be inserted into the inserting portion. In such a case, when the process cartridge is inserted into the inside of the image forming apparatus with the erroneous attitude, there is a possibility of an occurrence of damage of the image forming unit.

In the present invention, when the user inserts the process cartridge into the image forming apparatus with the erroneous attitude, a part of the process cartridge is located outside the opening to interfere with a portion constituting the opening.

In the present invention, the projected portion is provided to the guide portion as a part of the guide portion. As shown in FIG. 3A, projected portions 300*a* and 301*a* are provided at both ends of the guide portion 3*a*. As shown in FIG. 3A, a projected portion 300*b* guides the side surface of the process cartridge and on the other hand, a projected portion 301*b* contacts and guides the lower surface of the process cartridge.

Here, a mounting mechanism and a mounting operation of the process cartridges 50*a*, 50*b*, 50*c* and 50*d* will be described.

Figure 8A:
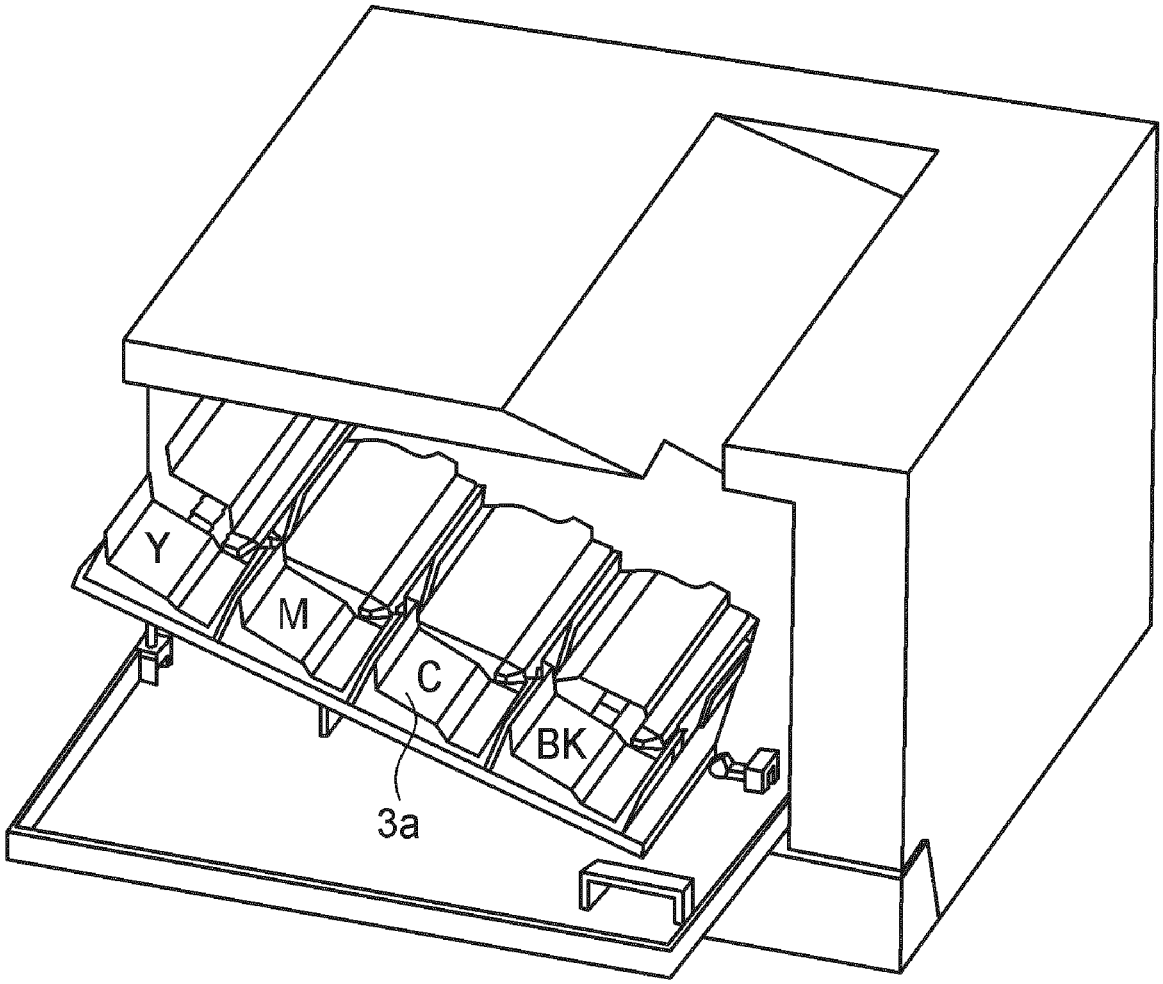
FIGS. 8A, 8B and 8C are schematic views for illustrating a sequence of an inserting operation of a process cartridge.
Figure 8B:
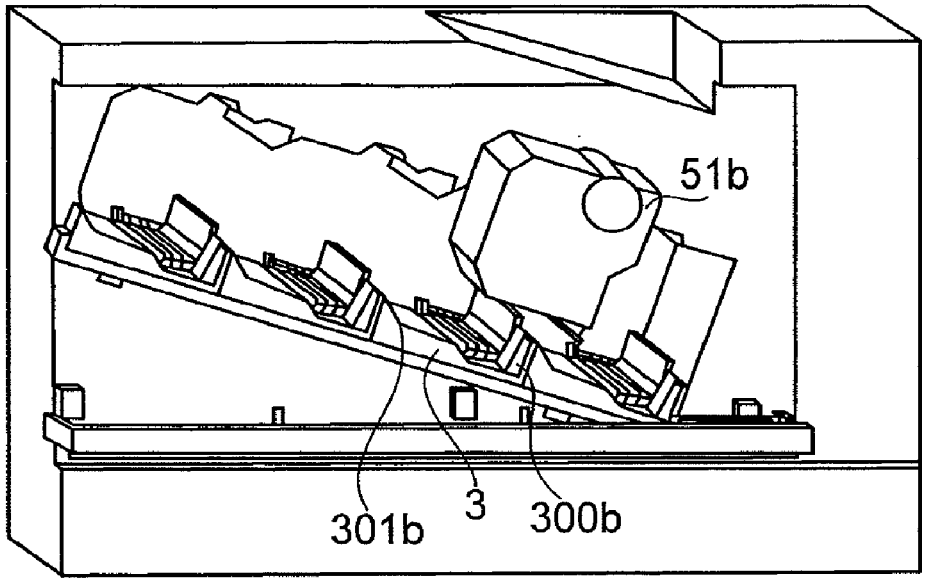
Figure 8C:
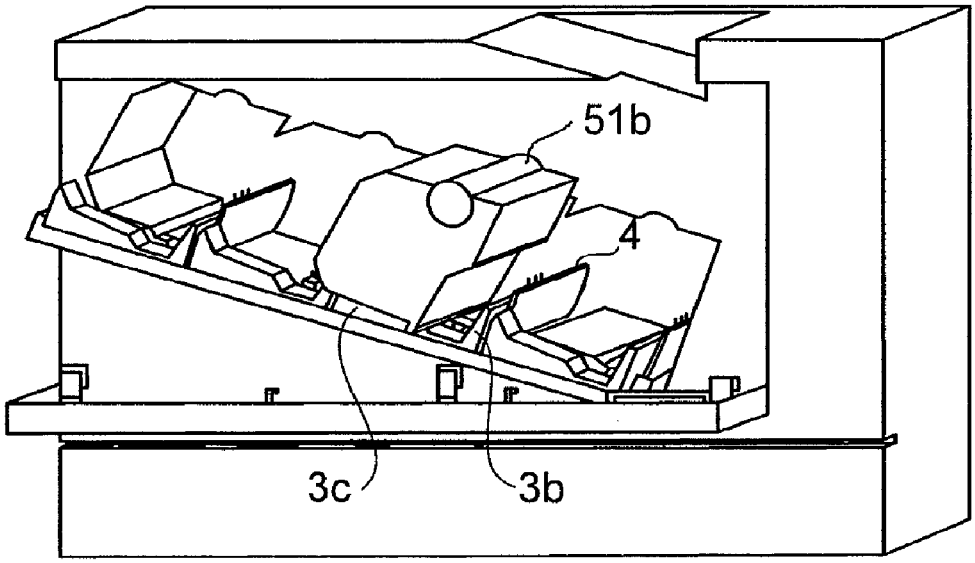

When the user mounts the process cartridge in the main assembly of the image forming apparatus, as shown in FIG. 8A, first the user opens the front cover 130. When the front cover 130 is opened, a display portion 3*a* indicating the color of an associated image forming unit is provided on a surface of the guide portion 3 located on an upper surface of the rotatable cover 122, thus showing a position of a process cartridge for a color to be inserted. In the case where the process cartridge 50*b* for cyan is set, the user can confirm the position thereof from above without looking inside laterally. When the process cartridge is intended to be mounted in a predetermined position, the guide portion 3 provided to the rotatable cover 122 is provided with tapered projected portions 300*b* and 301*b*, so that the process cartridge is mounted along the tapered projected portions 300*b* and 301*b* to the same extent (FIG. 8B). By this operation, the process cartridge is automatically guided to a proper insertion position (FIG. 8C). Then, the user pushes the process cartridge 50 in a rear surface direction. The pushed process cartridge 50 slides on the upper surface of the rotatable cover 122 and is guided to a process cartridge holding portion 4 by the guide portion 3 to be positioned with respect to the image forming apparatus 10. Thereafter, in this embodiment, the process cartridge is moved upward to a position of contact between the intermediary transfer member and the photosensitive drum. Thereafter, when the rotatable cover 122 is closed, the process cartridge is completely accommodated in the main assembly of the image forming apparatus. As described above, the image forming apparatus of this embodiment includes the rotatable cover 122 functioning as a guide member for the process cartridges 50*a*, 50*b*, 50*c* and 50*d*, thus facilitating mounting and demounting of the process cartridges 50*a*, 50*b*, 50*c* and 50*d*. That is, the user can visually recognize the display portion 3*a*, so that the user can mount the process cartridge only by pushing the process cartridge into the main assembly. Further, in the case where the process cartridge is pulled out of the image forming apparatus 10, the operation therefor is performed in reverse order of the above described order. Thus, the process cartridges 50*a*, 50*b*, 50*c* and 50*d* can be set in a predetermined position and a predetermined direction with reliability. Further, the process cartridges are slid on the rotatable cover 122, so that it is possible to alleviate a load, on the user, for supporting the process cartridges 50*a*, 50*b*, 50*c* and 50*d*. Further, target positions of the process cartridges 50*a*, 50*b*, 50*c* and 50*d* can be confirmed from above, so that mounting of the process cartridges is facilitated.

Figure 3C:
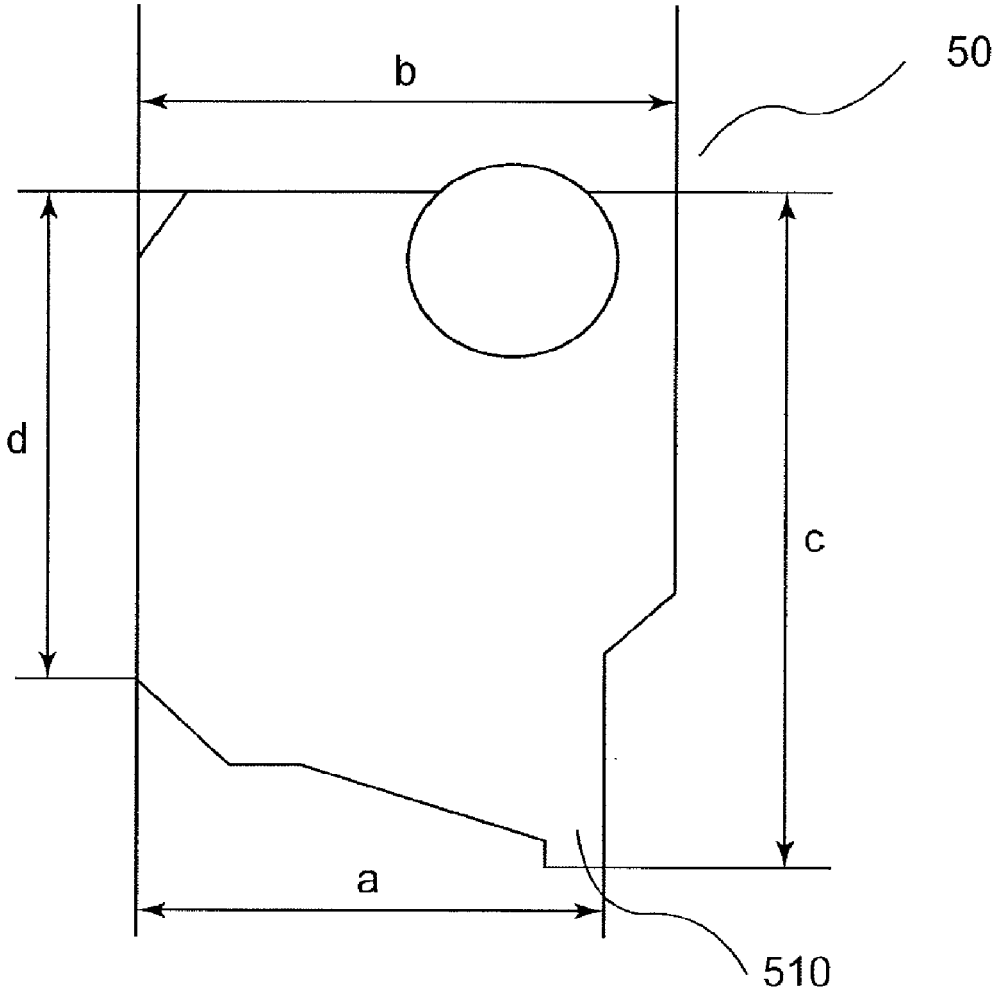
FIG. 3C is a sectional view of the process cartridge.
Figure 3D:
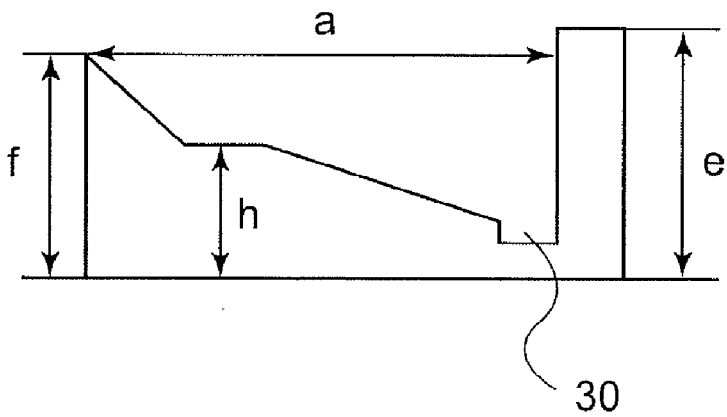
FIG. 3D is a sectional view of a guide portion.

Next, the process cartridge will be described with reference to FIG. 3C. Each of the process cartridges 50*a*, 50*b*, 50*c* and 50*d* has an outer shape such that the width b of the process cartridge at an uppermost portion (with respect to a cross-sectional direction) at which the photosensitive member 51*a*, 51*b*, 51*c*, 51*d* is located is greater than the width of the process cartridge at a lowermost portion contactable with the guide portion, so that the lowermost portion width a is a minimum width of the outer cross-sectional shape of the process cartridge. That is, in this embodiment, as shown in FIG. 3C, the widths a and b satisfy a relationship: $b>a$. The length (height) c of the process cartridge at a side surface and the width a satisfy a relationship: $c>a$. Further, the length (height) d of the process cartridge at another side surface, the length c, and the width b satisfy a relationship: $b<d<c$. FIG. 3D shows the height relationship of the guide portion. In this embodiment, heights e and f of the guide portion satisfy a relationship: $e>f$ as shown in FIG. 3D but the relationship between the heights e and f is not limited thereto.

The sum of the lengths (heights) d and f (d+f) is somewhat less than a length (height) g of the opening, i.e., $(d+f)<g$. This is because some play is provided in order to improve an insertion property of the process cartridge. However, the length g is required to satisfy either one of (e+c)>g and (f+c)>g. In this embodiment, the relationship: (f+c)>g is satisfied.

In the present invention, at least one of relationship: (b+e)>g and (b+f)>g is satisfied. This is because insertion of the process cartridge when the process cartridge is disposed with the side surface having the length c shown in FIG. 3C as a bottom surface can be prevented. In this embodiment, the relationship: (b+f)>g is satisfied.

Further, in order to prevent insertion of the process cartridge when the process cartridge is disposed with the side surface having the length d as a bottom, the following relationship (1) or (2) is satisfied:

$$d>a, \text{ or} \quad (1)$$

$$d<a \text{ and } (b+h)>g \text{ (}h\text{: the height of the guide portion at an intermediary portion as shown in FIG. 3D).} \quad (2)$$

In this embodiment, the relationship (1): d>a is satisfied.

The photosensitive member (photosensitive drum) 51*a*, 51*b*, 51*c*, 51*d* of each of the process cartridges 50*a*, 50*b*, 50*c* and 50*d* is projected from the surface of the process cartridge so that the photosensitive member 51*a*, 51*b*, 51*c*, 51*d* is exposed with an almost 90 degree-range of a circumferential surface of the photosensitive member so as to provide a minimum amount of projection. For example, in the case of a drum diameter of 40 mm, the amount of projection is about 5.4 mm and in the case of a drum diameter of 50 mm, the projection amount is about 6.7 mm. The four process cartridges are disposed obliquely with respect to a horizontal direction of the image forming apparatus (with a slope declining from an upper left portion to a lower right portion, e.g., in FIG. 1). Correspondingly, the intermediary transfer member 60 and the exposure device 70 are also disposed obliquely at an inclination (from the horizontal direction) equal to that of the process cartridges. In the opening 1, the partition portion between the adjacent process cartridges is omitted and the four process cartridges are obliquely disposed close to each other, so that an apparatus width of the main assembly can be considerably decreased.

A specific embodiment of insertion regulation will be described.

Figure 5:
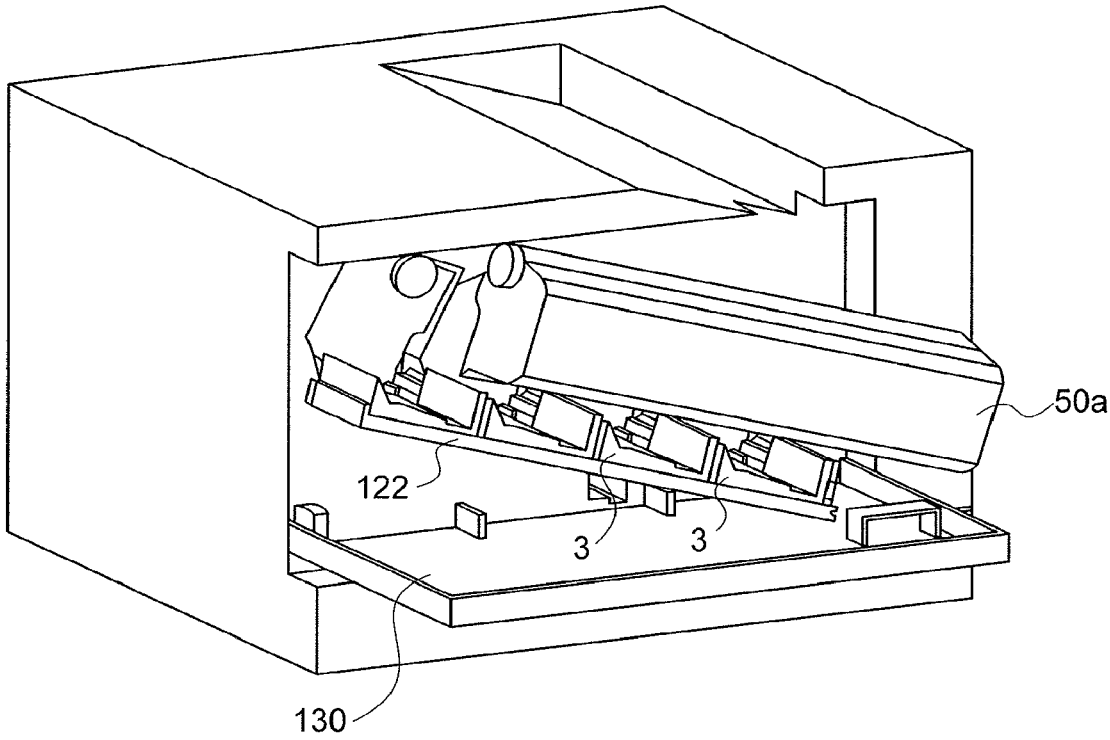

FIG. 5 illustrates the case where the process cartridge is being inserted in a state in which a longitudinal surface of the process cartridge is located on the front cover side. In this case, the process cartridge is placed on the projected portion 300 or 301 at a part of the longitudinal surface. Based on the above-described relationship: (b+f)>g, the process cartridge interferes with the projected portion at the inserting opening so that the process cartridge cannot be inserted.

Figure 6A:
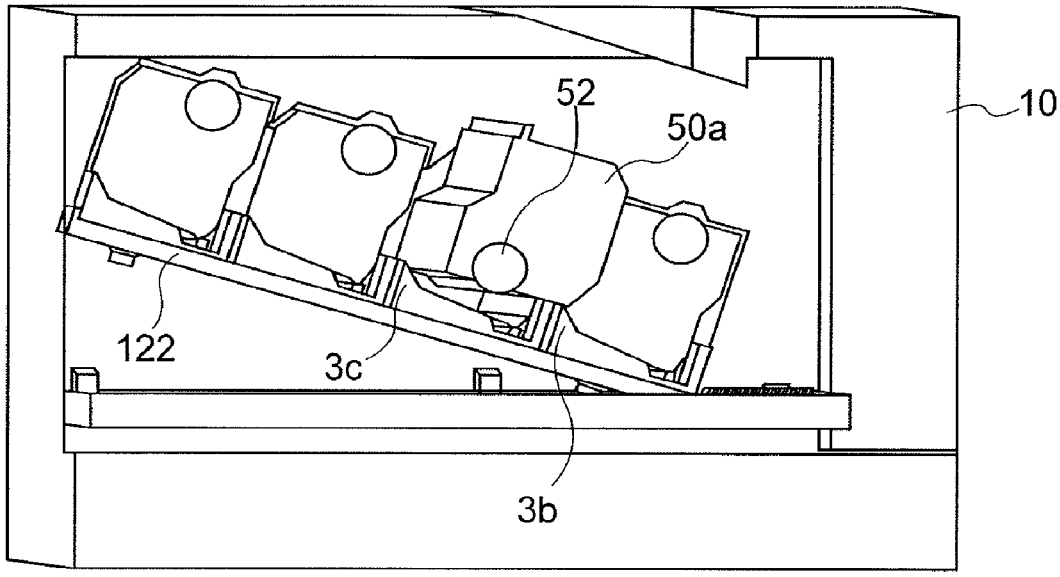
FIG. 6A is a schematic view showing the case where one of four process cartridges is mounted with a photosensitive drum located at a lower portion of the process cartridge.

Further, in FIG. 6A, an attempt is made to insert the process cartridge with an attitude such that the photosensitive drum is located at a lower portion of the process cartridge. The width of the process cartridge on the photosensitive drum side is more than a spacing between the projected portions 300 and 301, so that the process cartridge is placed on the projected portions. For that reason, based on the above-described relationship: (f+c)>g, insertion of the process cartridge is prevented by interference between the process cartridge and the projected portions.

In this embodiment, the projected portions also function as the guide portion but may also be a separate member which does not function as the guide portion.

In this embodiment, the process cartridge is provided with a projection 510 but in the case where this projection 510 is not engaged in the recessed portion 30, the process cartridge interferes with the guide portion at the inserting opening.

As described above, according to the present invention, even when the inserting portions of the adjacent image forming units are continuously connected to each other to form a large opening, it is possible to prevent insertion of the image forming unit with the erroneous attitude.

Second Embodiment

In this embodiment, members or portions identical to those in First Embodiment are represented by reference numerals or symbols identical to those in First Embodiment and redundant description will be omitted.

A mounting mechanism and a mounting operation of the process cartridges 50*a*, 50*b*, 50*c* and 50*d* will be described.

Figure 4:
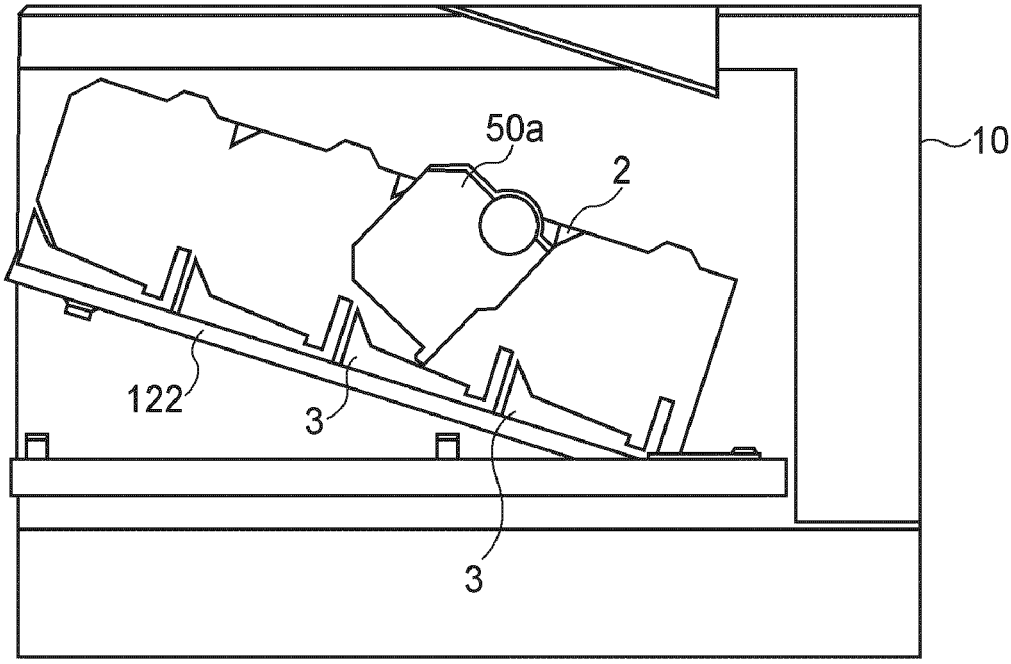
FIGS. 4 and 5 are schematic views each showing a state in which the process cartridge 50*a* is not properly inserted due to an erroneous insertion direction.
Figure 6B:
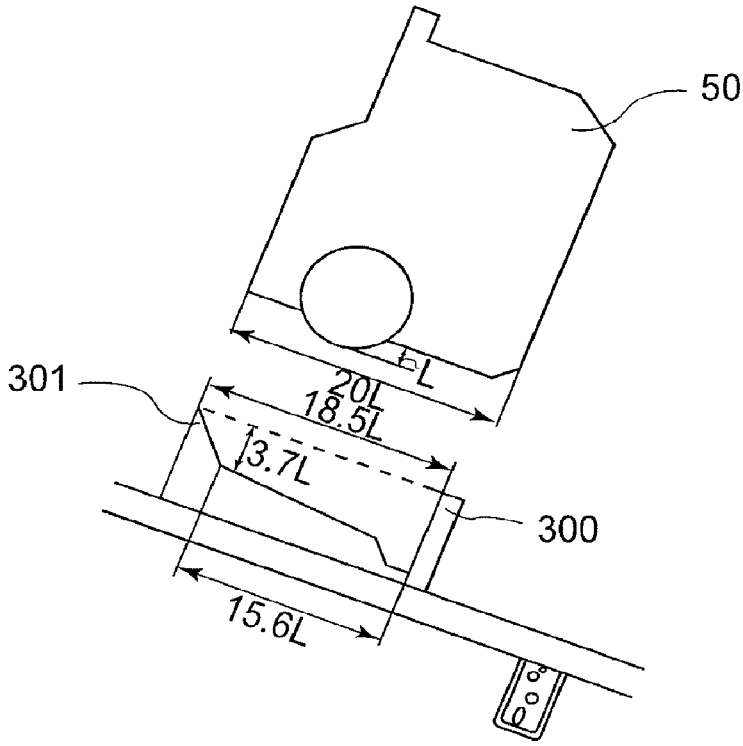
FIG. 6B is a schematic view for illustrating a positional relationship between the process cartridge and a guide portion.
Figure 7:
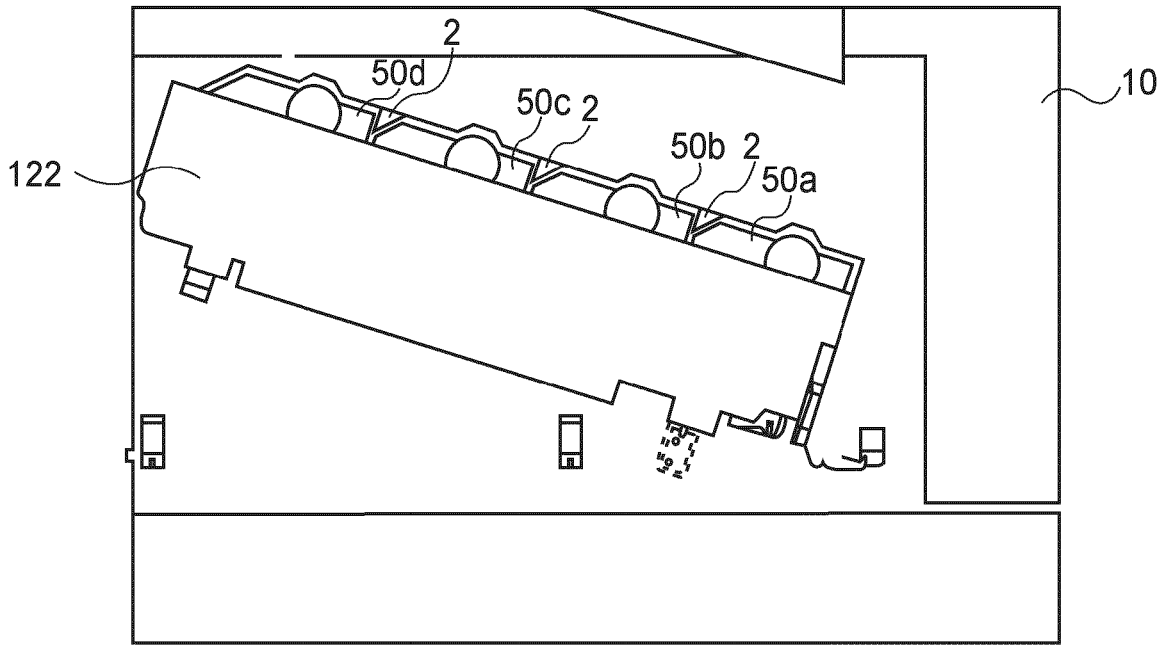
FIG. 7 is a schematic view showing a state in which a regulation member 2 is located above a rotatable cover 122 when the rotatable cover 122 is closed.

In FIG. 3A, the image forming apparatus 10 in which the process cartridges 50*a*, 50*b*, 50*c* and 50*d* are to be mounted is shown. In the opening 1, the regulating member 2 having a shape defining a substantially upper half of the outer shape of the process cartridge is provided. The rotatable cover 122 is rotationally moved frontward about the rotatable cover hinge 124 to open the opening 1. On the upper surface of the rotatable cover 122 at the opened position, the guide portion 3 defining a substantially lower half of the outer shape of the process cartridge is provided. Therefore, although the large opening opens at the front surface of the main assembly, the user can recognize a portion into which the process cartridge is to be inserted. Further, when the process cartridge is intended to be inserted in a different direction (in a state shown in FIG. 5), the width of each of the process cartridges, 50*a*, 50*b*, 50*c* and 50*d* is more than the spacing between the upper and lower regulating members 2 and 3, so that the process cartridge cannot enter the inside of the main assembly (FIGS. 4 and 5). Further, in the case where the process cartridge 50*a* is intended to be inserted upside down in a direction in which the process cartridge cannot enter the main assembly, the process cartridge 50*a* cannot enter the main assembly as a matter of course. In this case, a constitution in which the photosensitive drum is not damaged will be described with reference to FIG. 6B. Referring to FIG. 6B, L represents the amount of projection (projection amount) of the photosensitive drum projected from the process cartridge. The width of the process cartridge at the surface from which the photosensitive drum is projected is 20 L and the spacing between the projected portions 300 and 301 is 18.5 L. For this reason, when the surface of the process cartridge from which the photosensitive drum is projected is brought into contact with the guide portion, the process cartridge is disposed on the projected portions since the spacing between the projected portions is less than the width of the surface of the process cartridge. Further, in this embodiment, the distance between an end of the projected portions and a surface of the guide portion is 3.7 L, which is sufficiently larger than the projection amount (L) of the photosensitive drum. For that reason, even when the process cartridge is disposed on the guide portion in an arrangement as shown in FIG. 6A, it is possible to prevent contact of the photosensitive drum with the surface of the guide portion.

As described above, by the constitution of this embodiment, it is possible to prevent not only the insertion of the image forming unit into the inserting portion with the erroneous attitude but also damage on the photosensitive drum in the erroneous attitude.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 245544/2007 filed Sep. 21, 2007, which is hereby incorporated by reference.

What is claimed is:

1. An image forming apparatus comprising:

a plurality of image forming units, each provided with an image bearing member, detachably mountable to a main assembly of said image forming apparatus;

an opening, provided in a side surface of the main assembly, for permitting insertion of said plurality of image forming units into said opening;

guide means, provided through said opening, for guiding said plurality of image forming units toward said opening only when said opening is open; and a projected portion, provided on said guide means, that positions a part of an associated image forming unit outside said opening by contacting the associated image forming unit when the associated image forming unit is inserted into said opening with any attitude different from an attitude at the time when the associated image forming unit is disposed in the main assembly.

2. An apparatus according to claim 1, wherein said projected portion supports and guides the associated image forming unit so that the associated image forming unit is inserted into said opening with the same attitude as the attitude of the associated image forming unit at the time when the associated image forming unit is disposed in the main assembly.

3. An apparatus according to claim 1, wherein said projected portion projects in a direction perpendicular to an insertion direction of the associated image forming unit.

4. An apparatus according to claim 1, wherein the attitude of the associated image forming unit at the time when the associated image forming unit is disposed in the main assembly is the attitude in which an image bearing member of the associated image forming unit is located at an upper portion of the associated image forming unit.

5. An apparatus according to claim 4, wherein said guide means supports the associated image forming unit from below.

6. An apparatus according to claim 1, wherein said projected portion includes at least two projections provided at both end portions of said guide means with respect to the associated image forming unit with the attitude at the time when the associated image forming unit is disposed in the main assembly, and wherein the interval between adjacent projections is less than the width of the associated image forming unit on a side where an image bearing member of the associated image forming unit is provided.

7. An apparatus according to claim 6, wherein the interval from an end of said projected portion to a bottom surface of said guide means is greater than the distance that an image bearing member projects from its associated image forming unit.

8. An apparatus according to claim 6, wherein the height of said opening with respect to a height direction perpendicular to a direction in which said plurality of image forming units is arranged is less than the sum of the height of the projection and the height of the associated image forming unit with respect to the height direction with the attitude at the time when the associated image forming unit is disposed in the main assembly.

9. An apparatus according to claim 6, wherein the height of said opening with respect to a height direction perpendicular to a direction in which said plurality of image forming units is arranged is less than the sum of the height of the projection and the width of the associated image forming unit with respect to the width direction with the attitude at the time when the associated image forming unit is disposed in the main assembly.

10. An apparatus according to claim 1, wherein said guide means includes a cover that covers and uncovers said opening.

11. An image forming apparatus comprising:

a plurality of image forming units, each provided with an image bearing member, detachably mountable to a main assembly of said image forming apparatus, wherein each image forming unit has a first surface on which the image bearing member is disposed and has a second surface on which the image bearing member is not disposed, an opening, provided in a side surface of the main assembly, for permitting insertion of said plurality of image forming units into said opening;

an openable member that opens and closes said opening;

guide means, provided through said opening, for guiding said plurality of image forming units toward said opening only when said opening is open, wherein said guide means guides said plurality of image forming units toward said opening with the second surface downward while supporting said plurality of image forming units when said plurality of image forming units are disposed in the main assembly, and wherein said guide means positions a part of an associated image forming unit outside said opening by contacting the associated image forming unit when the associated image forming unit is inserted into said opening with an attitude different from an attitude at the time when the associated image forming unit is disposed in the main assembly.

12. An apparatus according to claim 11, further comprising a projected portion provided on said guide means.

13. An apparatus according to claim 12, wherein said projected portion projects in a direction perpendicular to an insertion direction of the associated image forming unit.

14. An apparatus according to claim 13, wherein said guide means supports the associated image forming unit from below.

15. An apparatus according to claim 12, wherein said projected portion includes at least two projections provided at both end portions of said guide means with respect to the associated image forming unit with the attitude at the time when the associated image forming unit is disposed in the main assembly, and wherein the interval between adjacent projections is less than the width of the associated image forming unit on a side where an image bearing member of the associated image forming unit is provided.

16. An apparatus according to claim 15, wherein the height of said opening with respect to a height direction perpendicular to a direction in which said plurality of image forming units is arranged is less than the sum of the height of the projection and the height of the associated image forming unit with respect to the height direction with the attitude at the time when the associated image forming unit is disposed in the main assembly.

17. An apparatus according to claim 15, wherein the height of said opening with respect to a height direction perpendicular to a direction in which said plurality of image forming units is arranged is less than the sum of the height of the projection and the width of the associated image forming unit with respect to a width direction with the attitude at the time when the associated image forming unit is disposed in the main assembly.

18. An apparatus according to claim 12, wherein the interval from an end of said projected portion to a bottom surface of said guide means is greater than the distance that an image bearing member projects from its associated image forming unit.

19. An apparatus according to claim 11, wherein the attitude of the associated image forming unit at the time when the associated image forming unit is disposed in the main assembly is the attitude in which an image bearing member of the associated image forming unit is located at an upper portion of the associated image forming unit.

20. An apparatus according to claim 11, wherein said guide means includes a cover that covers and uncovers said opening.

* * * * *